United States Patent [19]

Pfeiffer

[11] Patent Number: 5,022,173

[45] Date of Patent: Jun. 11, 1991

[54] SUSPENDED CEILING GRID SIGN WITH LOCKING, CANTILEVERED/COUNTERBALANCED BRACKET

[75] Inventor: Brian E. Pfeiffer, Pittsburgh, Pa.

[73] Assignee: Pittsburgh Tag Company, Pittsburgh, Pa.

[21] Appl. No.: 498,851

[22] Filed: Mar. 26, 1990

[51] Int. Cl.[5] ..... G09F 7/22

[52] U.S. Cl. ..... 40/617; 40/584; 52/38; 52/39

[58] Field of Search ..... 40/617, 584; 52/38, 52/39; 248/340, 343, 228, 231.8, 317

[56] References Cited

U.S. PATENT DOCUMENTS

| | | | |
|---|---|---|---|
| 3,561,718 | 2/1971 | Iverson | 248/340 |
| 3,743,228 | 7/1973 | Drab | 248/228 |
| 3,952,985 | 4/1976 | Davenport | 248/340 X |
| 4,073,458 | 2/1978 | Sease | 248/340 |
| 4,118,000 | 10/1978 | Campbell | 248/228 |
| 4,223,488 | 9/1980 | Schoenung | 52/39 |
| 4,229,913 | 10/1980 | Corrigan | 52/39 X |
| 4,564,165 | 1/1986 | Grant et al. | 248/343 |
| 4,667,913 | 5/1987 | Peelle et al. | 248/317 X |

*Primary Examiner*—Kenneth J. Dorner
*Assistant Examiner*—J. Hakomaki
*Attorney, Agent, or Firm*—Reed Smith Shaw & McClay

[57] ABSTRACT

The present invention relates to a sign that can be hung from a suspended ceiling. Specifically, the cantilevered and/or counterbalanced sign rests securely in the inverted "T" rail of a suspended ceiling tile grid, and can easily be inserted or removed without damaging or destroying the ceiling tile. At the same time, the cantilevered and counterbalanced structure of the present sign permits the sign to rest securely on grid rails with varying support ledge designs, shapes and dimensions.

22 Claims, 8 Drawing Sheets

SUSPENDED CEILING GRID SIGN WITH LOCKING, CANTILEVERED/COUNTERBALANCED BRACKET

FIELD OF THE INVENTION

The present invention relates to a sign that can be hung from a suspended ceiling, and more particularly, to an integral cantilevered and/or counterbalanced, locking bracket and sign that can be secured to the inverted "T" grid rail of a suspended tile ceiling.

BACKGROUND OF THE INVENTION

Hooks or clips that grip the inverted "T" grid rail of suspended ceilings are well known as devices for suspending signs and other weighted objects from suspended tile ceilings. Although these devices are useful for some purposes, there are a number of drawbacks to such means of attaching signs and other objects.

Suspended ceiling clips, such as the clip described in U.S. Pat. No. 4,073,458 ("the '458 patent"), utilize a "U" design attached to the lower edge of a grid rail. The '458 patent hanger clip is formed from a thin strip of metal with a U-bend portion formed in approximately the middle of the strip, that clips onto the horizontal ledge of the overhead beam, and lower end for attaching articles to. The '458 patent also uses a vertical portion extending from the upper end of the "U" clip which fits between the vertical leg of the overhead beam and a ceiling panel installed on that beam to hold the clip in position.

The device described in the '458 patent, although useful in some situations, may require the "U" clip conform to the dimensions of a specific grid rail. In the case of many present day suspended tile ceilings, "U" clips may be incapable of gripping grid rail ledges that can be ¼ inch or less in width, and that may have rounded or beveled edges and surfaces for aesthetic as well as functional qualities, as such narrow, beveled or rounded rails permit ceiling tiles to fit tighter, resulting in superior sound and heat insulation performance. "U" clips are easily dislodged from such grid rails, if they can be affixed to such rails at all.

If the grid rail ledge is wide, or the weight suspended from it is heavy, the legs of the clip may be pulled apart by the weight suspended from the lower portion of the clip, so as to no longer permit the clip to grip the grid rail.

Another disadvantage of the use of such clips is that in order for the suspended item to be held horizontally stable, at least two clips must generally be used. As suspended tiles may be extremely lightweight, the use of such clips to suspend heavy items from "T" rails can cause grid rails to bend or deform in the case of a clip that fails to distribute the weight of suspended items along the greatest possible surface area of the grid rail ledge. Low-strength rails may also twist, causing the clip to become dislodged and the object suspended below to fall.

Further, as the object is suspended below such "U" clips via wire, chain, or other means, it is more likely that an object will catch on an upper edge of the sign or object, thereby dislodging the clips from the grid rail. Clips can become dislodged by horizontal stress if they inflexibly grip a particular location on a grid rail. Finally, clips can deform, scratch or otherwise deface exposed lower surface of the grid rail.

Similarly, U.S. Pat. No. 4,223,488 ("the '488 patent") teaches a ceiling hanger adapted to be removably installed on tile ceiling grid rails; the hanger includes a plate having a U-shaped end portion embracing one edge of the grid rail, a midportion underlying the grid rail, and a retaining clip embracing the opposite edge of the grid rail. Advertisements or objects are to be hung from hooks or fasteners below the clips. The device described in the '488 patent, has limitations similar to those found in other grid rail clips.

Clips may offer insufficient resistance to a variety of anticipated and unanticipated dynamic stress situations. Grid rail clips, hooks, and other fastening means may also provide no satisfactory means to suspend a sign or other object over the center of a ceiling tile, as clips must be fastened to opposing grid rails and wires strung between the clips. Should one of the clips becomes dislodged (particularly in the case of a metal sign), the object can swing into or fall on personnel or equipment. A danger that an object passing below becoming entangled in the suspended wires traversing the clips may also exist.

It would therefore be desirable to develop a locking, suspended ceiling grid rail sign and bracket that will overcome the shortcomings of other grid rail clips and hooks.

SUMMARY OF THE INVENTION

The present invention provides a cantilevered/counterbalanced grid rail sign that will conform to the ledge of a suspended ceiling grid despite the width or thickness of that grid rail.

The sign/bracket of the present invention remains fixed by a supporting ledge that runs the length of the upper exposed edge of the sign; further, the cantilevered and/or counterbalanced structure of the sign locks it firmly in place, and need not be tailored to a grid rail of a particular width and thickness. The sign is supported by and its weight is evenly distributed along the entire ledge in contact with the grid rail.

Embodiments of the present invention are also such that the sign can be suspended away from the grid rail, towards the center of the suspended ceiling tile it is adjacent to, via its cantilevered and/or counterbalanced properties.

Other details, objects and advantages of the cantilevered/counterbalanced sign will become more readily apparent from the following descriptions of the presently preferred embodiments thereof.

BRIEF DESCRIPTION OF THE DRAWINGS

In the accompanying drawings, preferred embodiments of the invention are illustrated by way of example only, wherein.

DESCRIPTION OF THE PREFERRED EMBODIMENTS

Figure 1:
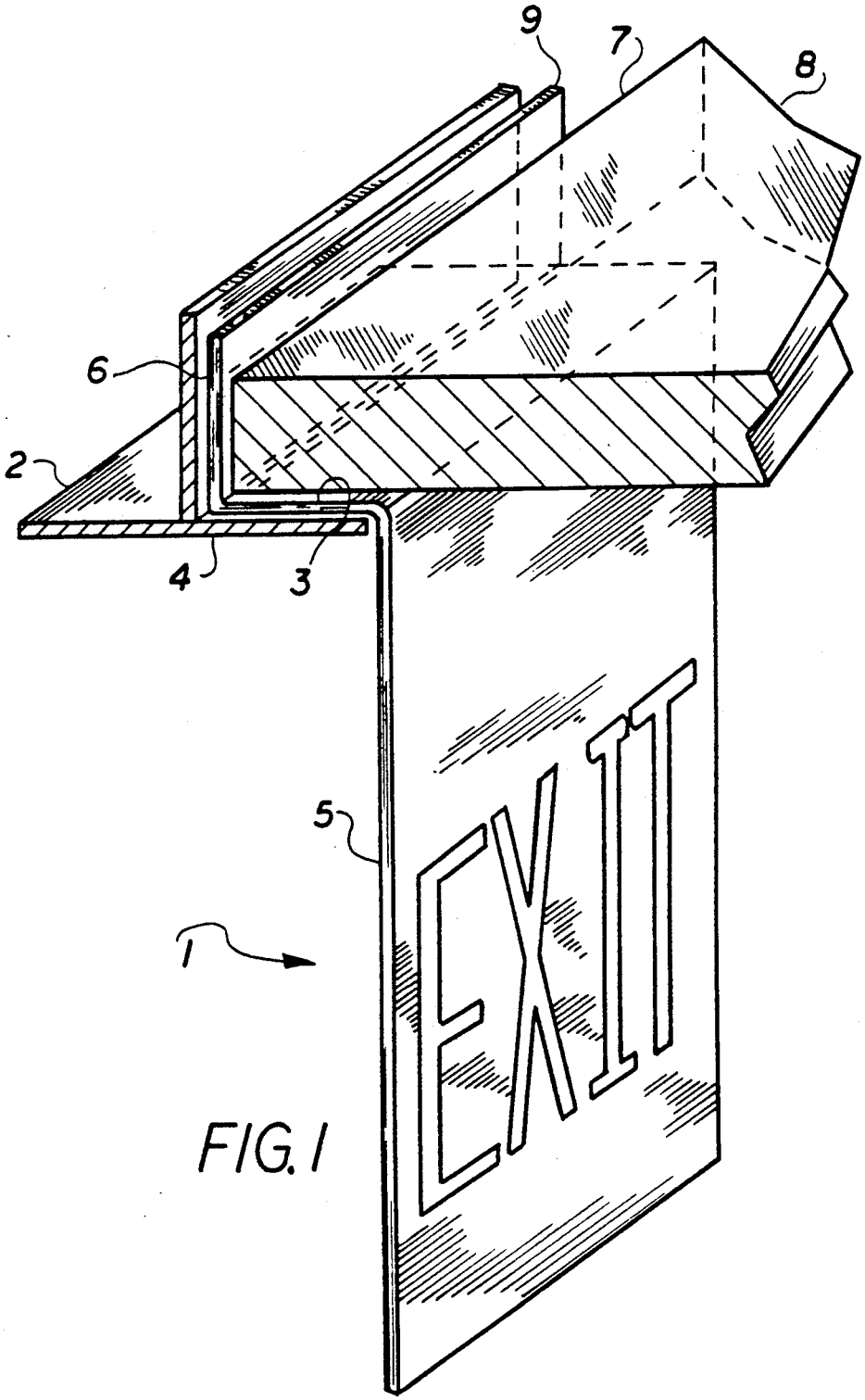
FIG. 1 shows a perspective view of the cantilevered sign of the present invention.

FIG. 1 shows a perspective view of cantilevered sign 1, attachable to inverted "T" grid rail 2 of a suspended tile ceiling. Horizontal flange 3 of sign 1 rests on ledge 4 of the inverted "T" grid rail; display surface 5 is suspended below the outer edge of horizontal flange 3. Vertical flange 6 of sign 1 rests against edge 7 of suspended ceiling tile 8. The weight of exposed, suspended display surface 5 of sign 1 is thereby cantilevered by the opposing force supplied by vertical flange 6 resting against end 7 of suspended ceiling tile 8; in this manner, the force of end 7 of ceiling tile provides opposing torque to the weight of display surface 5 suspended past the edge of ledge 4. This causes sign 1 to remain locked into position despite the anticipated or unanticipated static and dynamic forces that may act upon the suspended, exposed portion of sign 1. The weight of ceiling tile 8 on horizontal flange 4 provides additional stabilizing force on sign 1.

Sign 1 can easily be removed once vertical flange 6 is freed from its cantilevered resting position against edge 7 of suspended ceiling tile 8 by raising ceiling tile 8 above top edge 9 of vertical flange 6.

Figure 2:
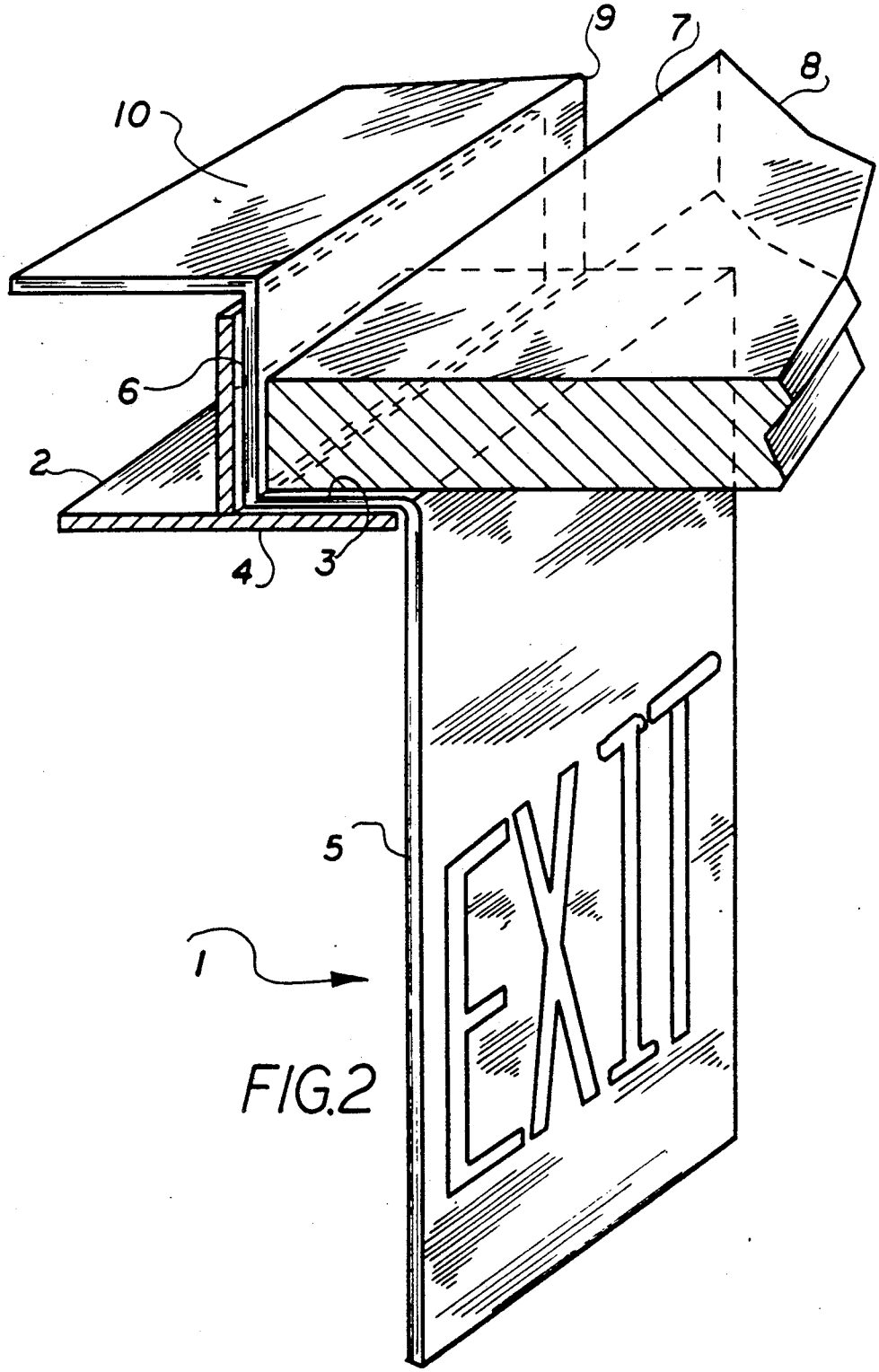
FIG. 2. shows a perspective view of one embodiment of the counterbalanced sign of the present invention.

Another embodiment of sign 1 is detailed in FIG. 2, which shows a counterbalanced embodiment of sign 1, resting on inverted "T" grid rail 2 of a suspended tile ceiling. Horizontal flange 3 of sign 1 rests on ledge 4 of the inverted "T" grid rail; display surface 5 is suspended below the outer edge of horizontal flange 3. Vertical flange 6 rests between grid rail 2 and edge 7 of suspended ceiling tile 8. Counterbalancing member 10 is attached to upper edge 9 of vertical flange 6, thereby holding the weight of the exposed, suspended display surface 5 of sign 1 in equilibrium below suspended ceiling tile 8. In this manner, the gravitational force of counterbalancing member 10 provides opposing torque to the weight of display surface 5 suspended past the edge of ledge 4. This causes sign 1 to remain locked into position despite the anticipated or unanticipated static and dynamic forces that may act upon the suspended, exposed portion of sign 1. The weight of ceiling tile 8 on horizontal flange 4 provides additional stabilizing force on sign 1.

Sign 1 as shown in FIG. 2 thereby remains balanced in position until ceiling tile 8 is raised, and sign 1 is lifted from ledge 4. Sign 1 can easily be removed once vertical flange 6 is freed from its balanced resting position on ledge 4 by raising ceiling tile 8 above top edge 9 of vertical flange 6, and removing counterbalancing member 10 from its position over grid rail 2.

Figure 3:
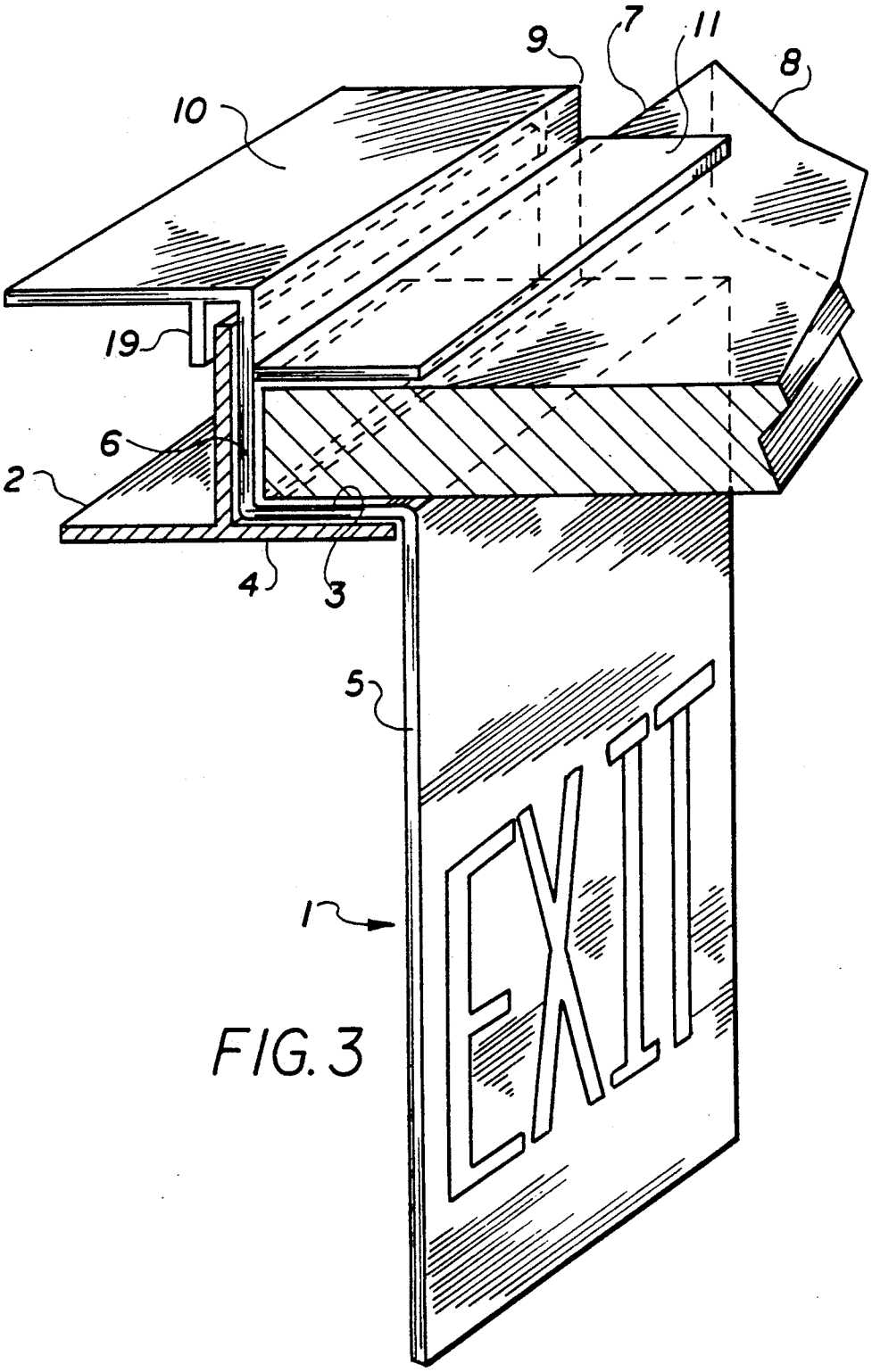
FIG. 3 shows a perspective view of a cantilevered and counterbalanced embodiment of the present invention.

FIG. 3 shows a cantilevered and counterbalanced embodiment of the present sign and integral bracket, also attachable to inverted "T" grid rail 2 of a suspended tile ceiling. This embodiment provides the increased capacity and stability that may be needed to suspended signs or similar objects at increased distances from grid rail. Heavier display surfaces or objects may also be suspended further from grid rail 2 towards the center of ceiling tile S, without sacrificing stability or safety.

Horizontal flange 3 of sign 1 rests on ledge 4 of the inverted "T" grid rail as shown in FIG. 3; display surface 5 is suspended below the outer edge of horizontal flange 3. Vertical flange 6 of sign 1 rests against edge 7 of suspended ceiling tile 8. The weight of exposed, suspended display surface 5 of sign 1 is thereby cantilevered by the opposing force supplied by vertical flange 6 resting against end 7 of suspended ceiling tile 8; in this manner, the force of end 7 of ceiling tile 8 provides opposing torque to the weight of display surface 5 suspended past the edge of ledge 4.

Counterbalancing member 10 is attached to upper edge 9 of vertical flange 6, thereby holding the weight of the exposed, suspended display surface 5 of sign 1 in equilibrium below suspended ceiling tile 8. In this manner, the gravitational force of counterbalancing member 10 provides opposing torque to the weight of display surface 5 suspended past the edge of ledge 4.

The cantilevered and counterbalancing forces acting on sign 1 as shown in FIG. 3 cause sign 1 to remain locked and balanced in position on grid rail 2. Sign 1 remains balanced and locked in position until ceiling tile 8 is raised and sign 1 is removed.

Horizontal safety tab 11 as shown in FIG. 3 provides protection against allowing sign 1 to become dislodged as a result of accidental impacts, air currents, or other dynamic forces that may act on the exposed, suspended portion of sign 1. Horizontal safety tab 11 is attached to upper edge 9 of vertical flange 6. Horizontal safety tab 11 may be shorter that the length of vertical flange 6, and may be bendable so as to adapt to the upper surface of ceiling tile 8.

Horizontal safety tab 11 is not required to support sign 1 during static conditions, and does not grasp ceiling tile 8, which is normally a soft and otherwise easily damaged insulating material.

FIG. 3 also shows cantilevered and counterbalanced sign 1 additionally equipped with safety flange 19 extending from vertical flange 6 over the upper edge of grid rail 2. Safety flange 19 provides protection against allowing sign 1 to become dislodged as a result of accidental impacts, air currents, or other dynamic forces that may act on the exposed, suspended portion of sign 1.

Safety tab 19 may be shorter than the length of vertical flange 6, and may be bendable so as to adapt to the upper edge of grid rail 2. Safety flange 19 is not required to support sign 1 during static conditions.

Figure 4:
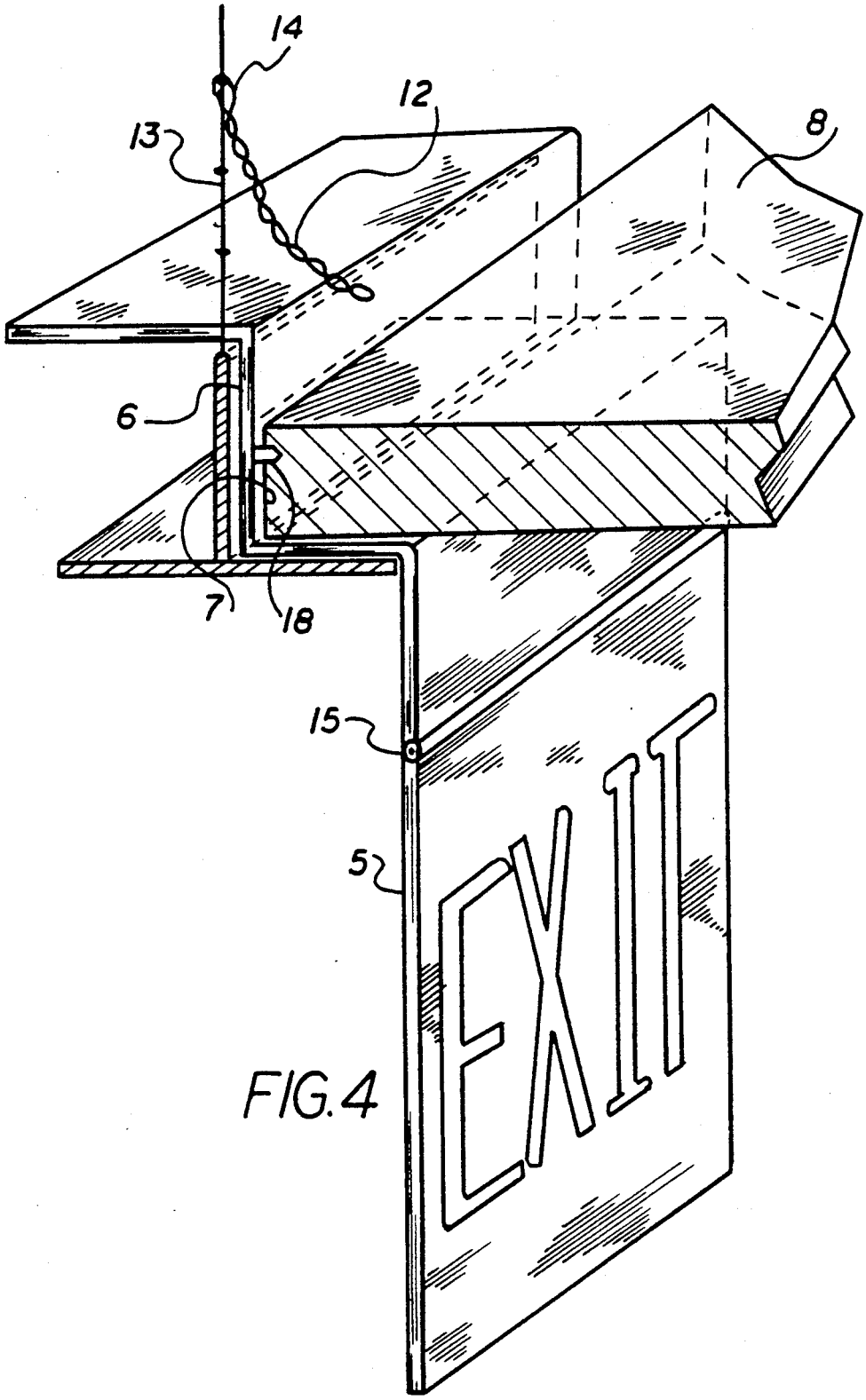
FIG. 4 shows another embodiment of the present invention.

The embodiment shown in FIG. 4 includes safety chain 12 attached at one end to vertical flange 6 of sign 1 as shown in FIG. 2. Safety chain 12 is attached at the other end to vertical flange 6 of sign 1 as fastened to grid rail support 13 via clasp 14 or similar means, so as to prevent sign 1 from falling should it be dislodged from grid rail 2. FIG. 4 also shows sign 1 equipped with hinge mechanism 15 near the upper edge of display surface 5 of sign 1. Hinge 15 permits the display surface 5 to swing freely if displaced by a force acting on it from below; display surface 5 may also be rotated into a horizontal, stored position when not in use.

FIG. 4 also shows retaining edge 18 which is slightly embedded into the soft insulating material that generally forms end 7 of ceiling tile 8. Retaining edge 18 provides a stabilizing means for vertical flange 6 to provide cantilevered support for display surface 5 of sign 1, and creates a tight fit for vertical flange 6 between grid rail 2 and end 7 of ceiling tile 8.

Figure 5:
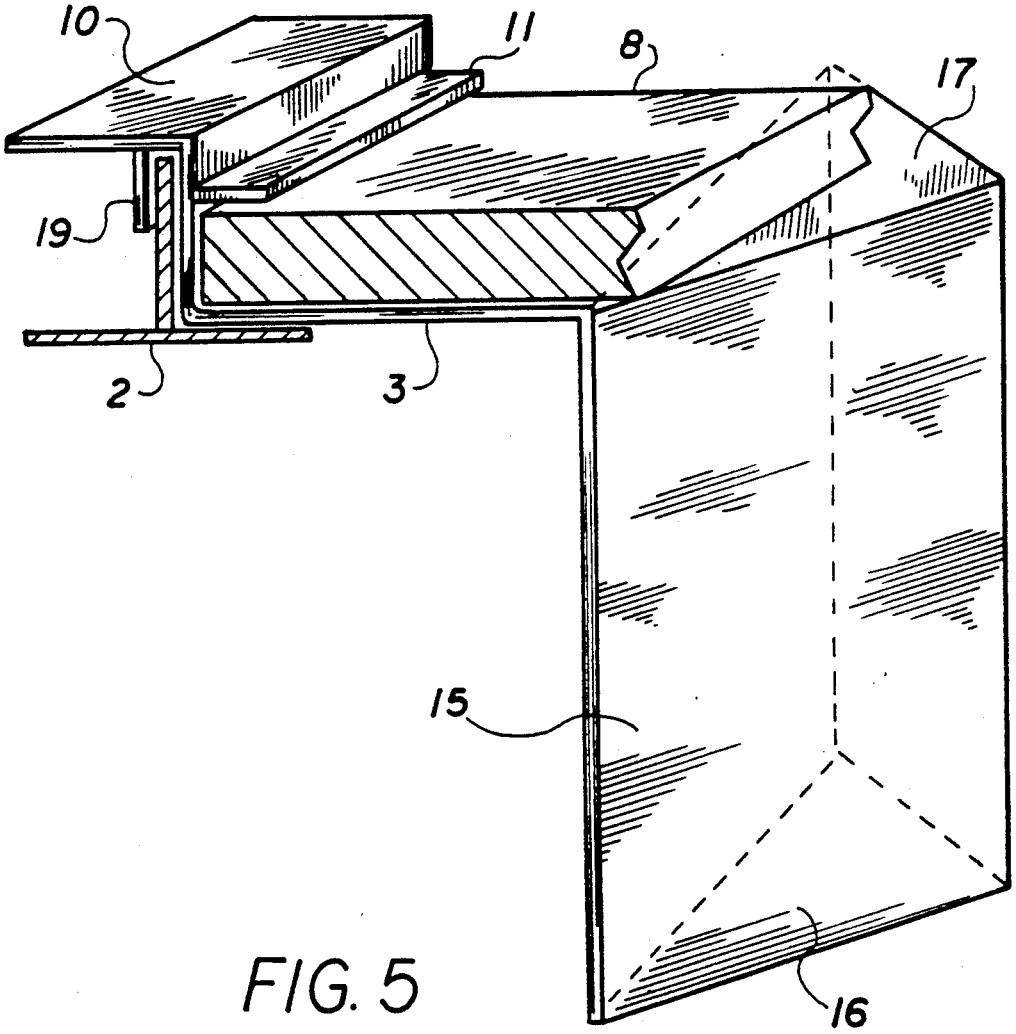
FIG. 5 shows another embodiment of the present invention.
Figure 6:
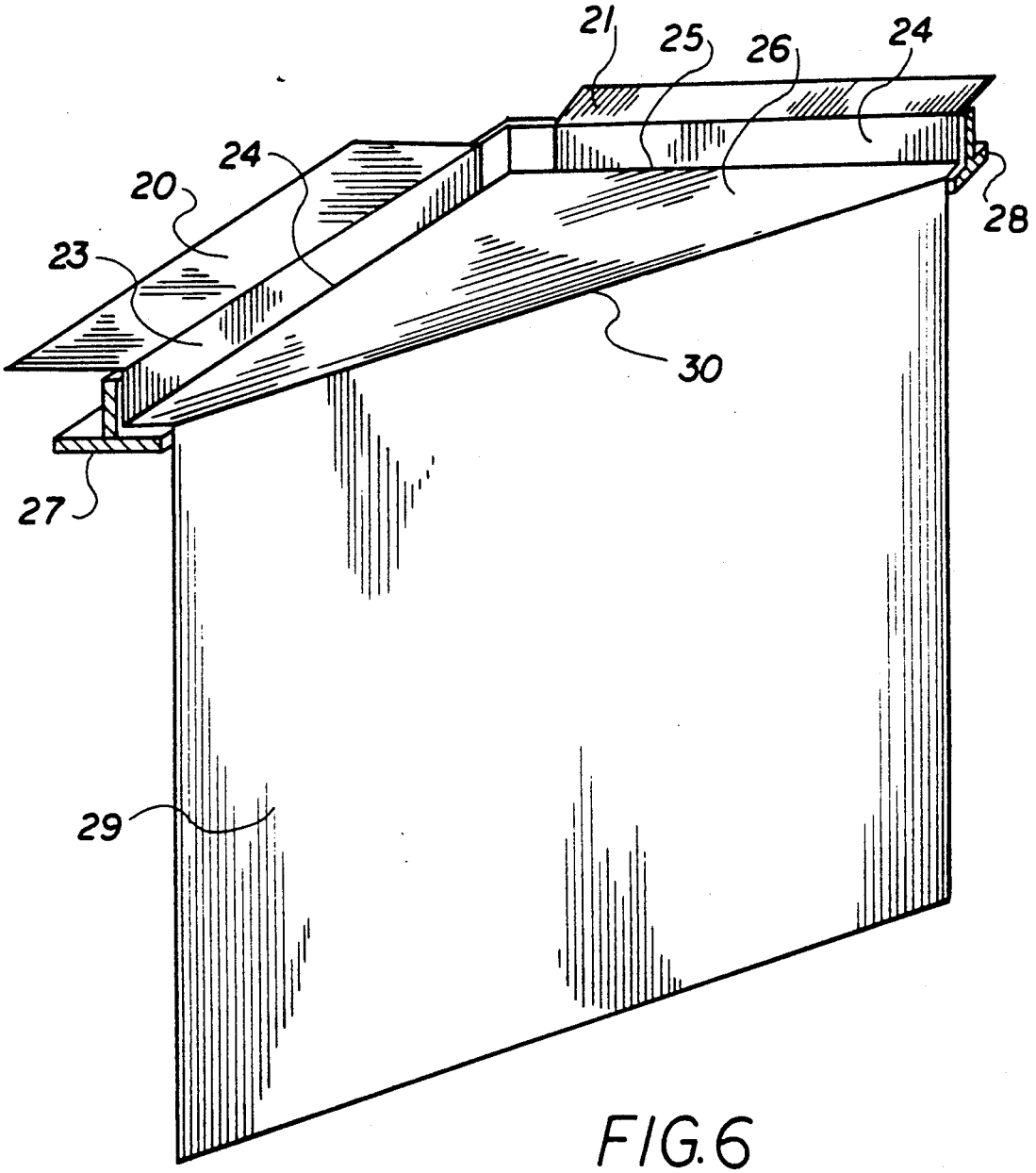
FIG. 6 shows another embodiment of the present invention.

FIG. 5 shows cantilevered and counterbalanced sign 1 with an extended horizontal flange 3 and extended counterbalance member 10 so as to permit multidimensional display surfaces 15, 16 and 17 to be suspended near the center of ceiling tile 8. FIG. 6 also shows sign 1 with horizontal safety tab 11 connected to vertical flange 6, extending over the upper surface of ceiling tile 8, and safety flange 19 also extending along the upper edge of vertical flange 6, locking over and down grid rail 2. Safety flange 19 and may be bendable so as so grasp grid rail 2, and horizontal safety tab 11 may be bendable so as so to conform to the upper surface of ceiling tile 8.

FIG. 6 shows cantilevered and counterbalanced sign 1 with two extended counterbalance members 20 and 21 connected to the upper edges of vertical flanges 22 and 23. Vertical flanges 22 and 23 are connected at the bottom edge to short sides 24 and 25 of right triangle-shaped horizontal flange 26 so as to fit together on an intersecting 90° corner of adjacent grid rails 27 and 28. Vertical sign plane 29 is attached to long side 30 of horizontal flange 26 so as to be suspended at a 90° angle below horizontal flange 26.

Figure 7:
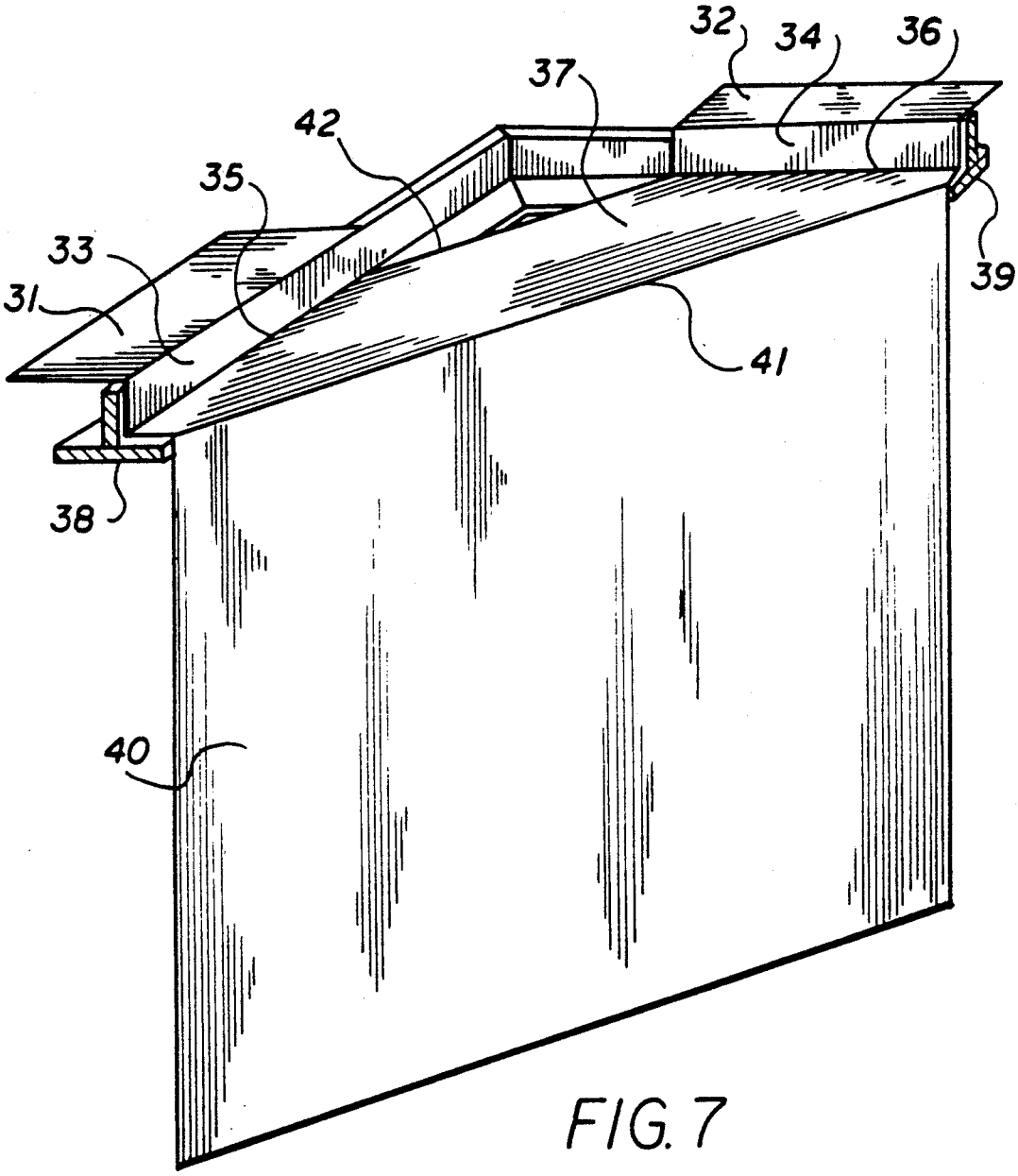
FIG. 7 shows another embodiment of the present invention.

FIG. 7 shows cantilevered and counterbalanced sign 1 with two extended counterbalance members 31 and 32 connected to the upper edges of vertical flanges 33 and 34. Vertical flanges 33 and 34 are connected at the bottom edge to grid rail edges 35 and 36 of four sided horizontal flange 37. The grid rail edges 35 and 36 of four sided horizontal flange 37 are at a 90° angle to each other, so as to permit four sided horizontal flange 37 to fit on intersecting 90° corner of adjacent grid rails 38 and 39. Vertical sign plane 40 is attached to long side 41, opposite short side 42 of four sided horizontal flange 37, so as to be suspended at a 90° angle below four sided horizontal flange 37.

Figure 8:
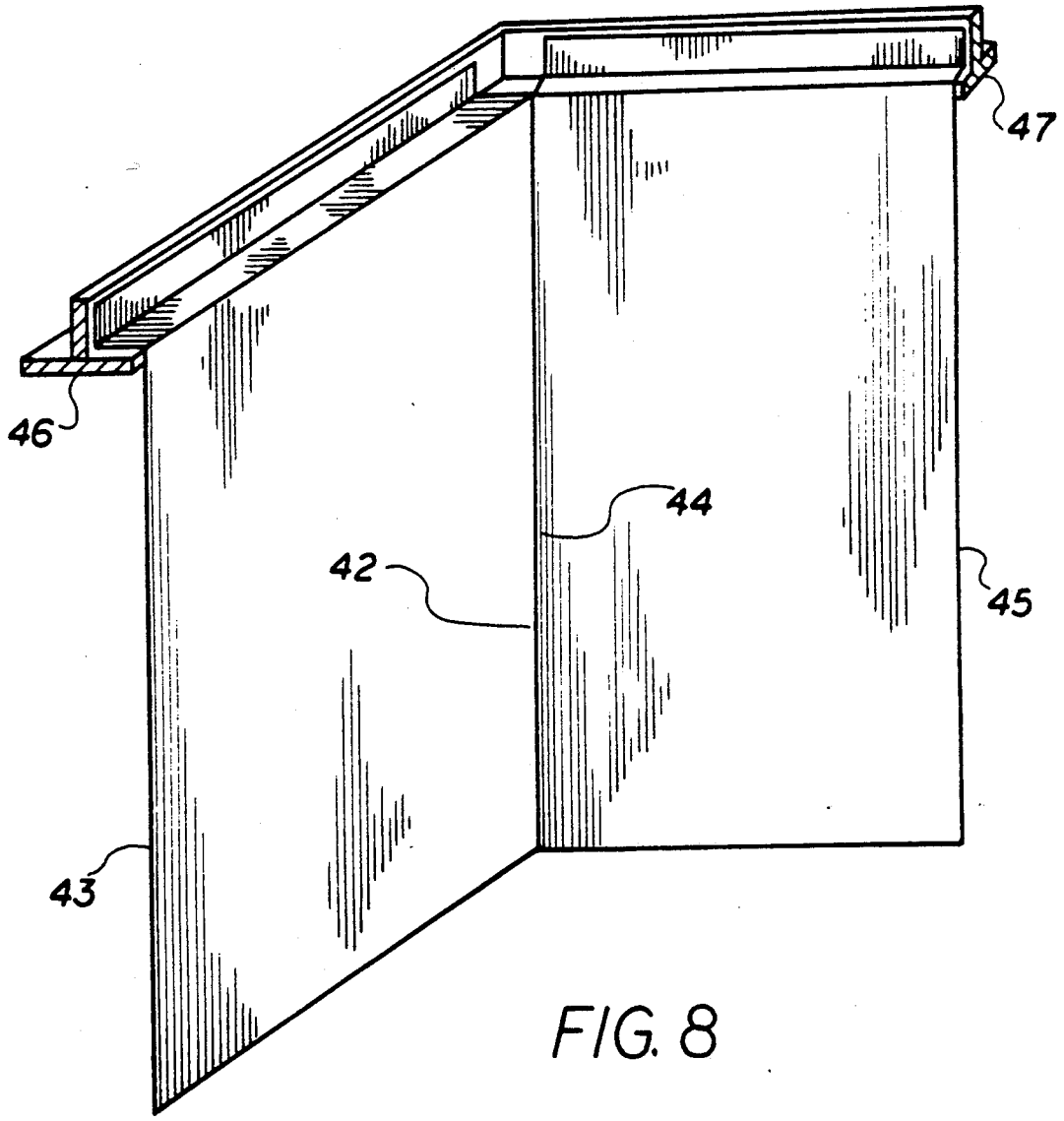
FIG. 8 shows another embodiment of the present invention.

The embodiment of FIG. 8 includes two cantilevered signs as shown in FIG. 1 in which vertical edge 42 of vertical display surface 43 is attached to vertical edge 44 of vertical display surface 45 is attached at a 90° angle so as to fit together on an intersecting 90° corner of adjacent grid rails 46 and 47.

While presently preferred embodiments of practicing the invention has been shown and described with particularity in connection with the accompanying drawings, the invention may be otherwise embodied within the scope of the following claims.

What is claimed is:

1. A sign for attachment to a grid rail of a suspended tile ceiling comprising:

a first vertical member having an upper edge and being capable of accommodating a sign;

a horizontal flange having a rail edge and an outer edge, said outer edge being connected to the upper edge of the first vertical member, said horizontal flange being substantially perpendicular to the first vertical member, and whereby the horizontal flange is capable of resting on a ledge of the grid rail; and a second vertical member having a lower edge, said lower edge being connected to the rail edge of the horizontal flange, said second vertical member extending upwardly from and substantially perpendicular to the horizontal flange, and whereby the second vertical member is capable of resting against an end of a ceiling tile so as to provide cantilevered support for the first vertical member.

2. A sign for attachment to a grid rail of a suspended tile ceiling comprising:

a first vertical member having an upper edge and being capable of accommodating a sign;

a horizontal flange having a rail edge and an outer edge, said outer edge being connected to the upper edge of the first vertical member, said horizontal flange being substantially perpendicular to the first vertical member, and whereby the horizontal flange is capable of resting on a ledge of the grid rail; and a second vertical member having an upper edge and a lower edge, said lower edge being connected to the rail edge of the horizontal flange, said second vertical member extending upwardly from and substantially perpendicular to the horizontal flange, and whereby the second vertical member is capable of resting against an end of a ceiling tile; and a counterbalancing member having an edge, said edge of the counterbalancing member being connected to the upper edge of the second vertical member, said counterbalancing member extending substantially perpendicular to the second vertical member and in an opposite direction from the second vertical member as the horizontal flange, and whereby the counterbalancing member is capable of extending over the grid rail, enabling said counterbalancing member to balance the first vertical member in position below the suspended tile ceiling.

3. A sign for attachment to a grid rail of a suspended tile ceiling comprising:

a first vertical member having an upper edge and being capable of accommodating a sign;

a horizontal flange having a rail edge and an outer edge, said outer edge being connected to the upper edge of the first vertical member, said horizontal flange being substantially perpendicular to the first vertical member, and whereby the horizontal flange is capable of resting on a ledge of the grid rail; and a second vertical member having an upper edge and a lower edge, said lower edge being connected to the rail edge of the horizontal flange, said second vertical member extending upwardly from and substantially perpendicular to the horizontal flange, and whereby the second vertical member is capable of resting against an end of a ceiling tile, enabling the counterbalancing member to provide cantilevered support for the first vertical member; and a counterbalancing member having an edge, said edge of the counterbalancing member being connected to the upper edge of the second vertical member, said counterbalancing member extending substantially perpendicular to the second vertical member and in an opposite direction from the second vertical member as the horizontal flange, and whereby the counterbalancing member is capable of extending over the grid rail, enabling said counterbalancing member to balance the first vertical member in position below the suspended tile ceiling.

4. A sign for attachment to a grid rail of a suspended tile ceiling as set forth in claim 1, said sign additionally including at least one hinge near the upper edge of the first vertical member enabling said first vertical member to swing about an axis comprising said hinge.

5. A sign for attachment to a grid rail of a suspended tile ceiling as set forth in claim 1, said sign additionally comprising at least one safety tab extending from the upper edge of the second vertical member, said safety tab being to be capable of resting over an upper edge of the grid rail.

6. A sign for attachment to a grid rail of a suspended tile ceiling as set forth in claim 1, said sign additionally comprising at least one safety tab extending from the upper edge of the second vertical member, said safety tab being capable of hooking over an upper edge of the grid rail and capable of being crimped, enabling said safety tab to grip the grid rail.

7. A sign for attachment to a grid rail of a suspended tile ceiling as set forth in claim 1, said sign additionally comprising at least one horizontal support tab connected to the upper edge of the second vertical member, said horizontal support tab being capable of extending from the second vertical member over an upper surface a ceiling tile.

8. A sign for attachment to a grid rail of a suspended tile ceiling as set forth in claim 1, said sign additionally comprising at least one horizontal support tab connected to the upper edge of the second vertical member, said horizontal support tab being capable of extending from the second vertical member over an upper surface a ceiling tile and capable of being be crimped, enabling said horizontal support tab to conform to the upper surface a ceiling tile.

9. A sign for attachment to a grid rail of a suspended tile ceiling as set forth in claim 1, said sign additionally comprising a retaining member connected to and protruding from the second vertical flange, said retaining member capable of being embedded into an end of a ceiling tile enabling said retaining member to stabilize the second vertical member.

10. A sign for attachment to a grid rail of a suspended tile ceiling as set forth in claim 1, said sign additionally comprising a safety chain connected to and extending from the upper edge of the second vertical member, said safety chain capable of being connected to an overhead support member.

11. A first and a second sign for attachment to a grid rail of a suspended tile ceiling each as set forth in claim 1, said first sign additionally including a first vertical edge on the first vertical member and said second sign additionally including a first vertical edge on the first vertical member, said vertical edge of the first vertical member of the second sign connected to the vertical edge of the first vertical member of the first sign, said first sign and said second sign being capable of fitting on an intersecting 90° angle corner of two adjacent grid rails.

12. A first and a second sign for attachment to a grid rail of a suspended tile ceiling each as set forth in claim 2, said first sign additionally including a first vertical edge on the first vertical member and said second sign additionally including a first vertical edge on the first vertical member, said vertical edge of the first vertical member of the second sign connected to the vertical edge of the first vertical member of the first sign, said first sign and said second sign being capable of fitting on an intersecting 90° angle corner of two adjacent grid rails.

13. A first and a second sign for attachment to a grid rail of a suspended tile ceiling each as set forth in claim 3, said first sign additionally including a first vertical edge on the first vertical member and said second sign additionally including a first vertical edge on the first vertical member, said vertical edge of the first vertical member of the second sign connected to the vertical edge of the first vertical member of the first sign, said first sign and said second sign being capable of fitting on an intersecting 90° angle corner of two adjacent grid rails.

14. A sign for attachment to the grid rail of a suspended tile ceiling as set forth in claim 3 in which the first vertical member, the horizontal flange, the second vertical member and the counterbalancing member are comprised of metal.

15. A sign for attachment to the grid rail of a suspended tile ceiling as set forth in claim 3 in which the first vertical member, the horizontal flange, the second vertical member and the counterbalancing member are comprised of sheet aluminum.

16. A sign for attachment to the grid rail of a suspended tile ceiling as set forth in claim 3 in which the first vertical member, the horizontal flange, the second vertical member and the counterbalancing member are comprised of semirigid plastic.

17. A sign for attachment to a grid rail of a suspended tile ceiling as set forth in claim 1 in which the horizontal flange is a right isosceles triangle having a hypotenuse edge, a first isosceles edge and a second isosceles edge, said horizontal flange being capable of fitting on an intersecting 90° angle corner of two adjacent grid rails, whereby the upper edge of the first vertical member is connected to the hypotenuse edge of the horizontal flange, the lower edge of the second vertical member is connected to the first isosceles side of the horizontal flange, said sign additionally comprising:

a third vertical member having a lower edge, said lower edge of the third vertical member being connected to the second isosceles edge of the horizontal flange and said third vertical member extending upwardly from and substantially perpendicular to the horizontal flange, said the third vertical member being capable of resting against an end of a ceiling tile enabling the third vertical member to provide cantilevered support for the first vertical member.

18. A sign for attachment to the a grid rail of a suspended tile ceiling as set forth in claim 1 in which the horizontal flange is a four sided panel having a first grid rail edge, a grid second rail edge, a long outer edge and a short inner edge, said four sided panel capable of fitting on two adjacent grid rails intersecting at a 90° angle, whereby the upper edge of the first vertical member is connected to the long outer edge of the horizontal flange, the lower edge of the second vertical member is connected to the first grid rail edge of the horizontal flange, said sign additionally comprising:

a third vertical member having a lower edge, said lower edge of the third vertical member being connected to the second grid rail edge of the horizontal flange, said third vertical member extending upwardly from and substantially perpendicular to the horizontal flange, said the third vertical member being capable of resting against an end of a ceiling tile enabling the third vertical member to provide cantilevered support for the first vertical member.

19. A sign for attachment to a grid rail of a suspended tile ceiling as set forth in claim 2 in which the horizontal flange is a right isosceles triangle having a hypotenuse edge, a first isosceles edge and a second isosceles edge and is capable of fitting on an intersecting 90° angle corner of two adjacent grid rails, whereby the upper edge of the first vertical member is connected to the hypotenuse edge of the horizontal flange, the lower edge of the second vertical member is connected to the first isosceles side of the horizontal flange, said sign additionally comprising:

a third vertical member having an upper edge and a lower edge, said lower edge of the third vertical member being connected to the second isosceles edge of the horizontal flange, said third vertical member extending upwardly from and substantially perpendicular to the horizontal flange, said third vertical member being capable of resting against an end of a ceiling tile; and a second counterbalancing member having an edge, said edge of the second counterbalancing member being connected to the upper edge of the third vertical member, said second counterbalancing member being capable of extending over a second grid rail enabling the second counterbalancing member to balance the first vertical member in position below the suspended tile ceiling.

20. A sign for attachment to a grid rail of a suspended tile ceiling as set forth in claim 2 in which the horizontal flange is a four sided panel having a first grid rail edge, a grid second rail edge, a long outer edge and a short inner edge, said four sided panel capable of fitting on two adjacent grid rails intersecting at a 90° angle, whereby the upper edge of the first vertical member is connected to the long outer edge of the horizontal flange, the lower edge of the second vertical member is connected to the first grid rail edge of the horizontal flange, said sign additionally comprising:

a third vertical member having an upper edge and a lower edge, said lower edge of the third vertical member being connected to the second grid rail edge of the horizontal flange, said third vertical member extending upwardly from and substantially perpendicular to the horizontal flange, said the third vertical member being capable of resting against an end of a ceiling tile; and a second counterbalancing member having an edge, said edge of the second counterbalancing member being connected to the upper edge of the third vertical member, said second counterbalancing member being capable of extending over a second grid rail enabling said second counterbalancing member to balance the first vertical member in position below the suspended tile ceiling.

21. A sign for attachment to a grid rail of a suspended tile ceiling as set forth in claim 3 in which the horizontal flange is a right isosceles triangle having a hypotenuse edge, a first isosceles edge and a second isosceles edge and is capable of fitting on an intersecting 90° angle corner of two adjacent grid rails, whereby the upper edge of the first vertical member is connected to the hypotenuse edge of the horizontal flange, the lower edge of the second vertical member is connected to the first isosceles side of the horizontal flange, said sign additionally comprising:

a third vertical member having an upper edge and a lower edge, said lower edge of the third vertical member being connected to the second isosceles edge of the horizontal flange, said third vertical member extending upwardly from and substantially perpendicular to the horizontal flange, said the third vertical member being capable of resting against an end of a ceiling tile enabling the third vertical member to provide cantilevered support for the first vertical member; and a second counterbalancing member having an edge, said edge of the second counterbalancing member being connected to the upper edge of the third vertical member, said second counterbalancing member being capable of extending over a second grid rail enabling said second counterbalancing member to balance the first vertical member in position below the suspended tile ceiling.

22. A sign for attachment to the grid rail of a suspended tile ceiling as set forth in claim 3 in which the horizontal flange is a four sided panel having a first grid rail edge, a grid second rail edge, a long outer edge and a short inner edge, said four sided panel capable of fitting on two adjacent grid rails intersecting at a 90° angle, whereby the upper edge of the first vertical member is connected to the long outer edge of the horizontal flange, the lower edge of the second vertical member is connected to the first grid rail edge of the horizontal flange, said sign additionally comprising:

a third vertical member having an upper edge and a lower edge, said lower edge of the third vertical member being connected to the second grid rail edge of the horizontal flange, said third vertical member extending upwardly from and substantially perpendicular to the horizontal flange, said the third vertical member being capable of resting against an end of a ceiling tile enabling the third vertical member to provide cantilevered support for the first vertical member; and a second counterbalancing member having an edge, said edge of the second counterbalancing member being connected to the upper edge of the third vertical member, said second counterbalancing member being capable of extending over a second grid rail enabling said second counterbalancing member to balance the first vertical member in position below the suspended tile ceiling.

* * * * *